United States Patent [19]

Crozier

[11] Patent Number: 4,756,405

[45] Date of Patent: Jul. 12, 1988

[54] ARTIST BRUSH BOX

[76] Inventor: Donald L. Crozier, 1370 Crawford Ave., Upland, Calif. 91786

[21] Appl. No.: 60,500

[22] Filed: Jun. 11, 1987

[51] Int. Cl.[4] ..... B65D 85/20

[52] U.S. Cl. ..... 206/1.7; 206/362; 211/65

[58] Field of Search ..... 206/1.7–1.9, 206/209, 361, 362; 211/65, 124; 248/110, 113, 359 R; 312/206

[56] References Cited

U.S. PATENT DOCUMENTS

| | | | |
|---|---|---|---|
| 286,405 | 10/1883 | Edwards | 211/65 |
| 305,544 | 9/1884 | Stirrup . | |
| 1,094,099 | 4/1914 | Reilly | 211/65 |
| 1,979,241 | 11/1934 | Albanese et al. | 206/362 |
| 2,043,643 | 6/1936 | Yenne | 206/362 |
| 2,150,706 | 3/1939 | Adams . | |
| 2,521,049 | 9/1950 | Divis | 248/113 |
| 2,952,364 | 9/1960 | Jacobson | 211/65 |
| 3,077,977 | 2/1963 | Wood . | |
| 3,095,000 | 6/1963 | Hirst | 211/65 |
| 3,168,962 | 2/1965 | Rawlins et al. | 248/110 |
| 3,446,337 | 5/1969 | Blackmon . | |
| 3,946,878 | 3/1976 | Stoveken et al. | 211/124 |
| 4,116,332 | 9/1978 | Hartley | 206/209 |
| 4,134,525 | 1/1979 | Respoli . | |
| 4,162,005 | 7/1979 | Linger . | |
| 4,377,239 | 3/1983 | Jimae | 211/65 |
| 4,573,569 | 3/1986 | Parker | 206/1.7 |

FOREIGN PATENT DOCUMENTS

| | | | |
|---|---|---|---|
| 1084718 | 1/1955 | France | 248/113 |
| 1358531 | 3/1964 | France | 206/1.7 |
| 0046150 | 10/1918 | Sweden | 206/1.7 |

*Primary Examiner*—Jimmy G. Foster

*Attorney, Agent, or Firm*—Harvey S. Hertz

[57] ABSTRACT

An artist brush box includes a plurality of brush holders. Each brush holder is adapted to releasably secure an artist brush thereto. The brush holders are movable for adjustably positioning the brushes in the box. The brush holders are also rotatably secured to a mounting rod enabling the brushes to be rotatably positioned. In a first position, the brush bristles rest flat against a surface of the brush box and in a second position the brushes can be rotated for use by the artist.

3 Claims, 1 Drawing Sheet

FIG. 1
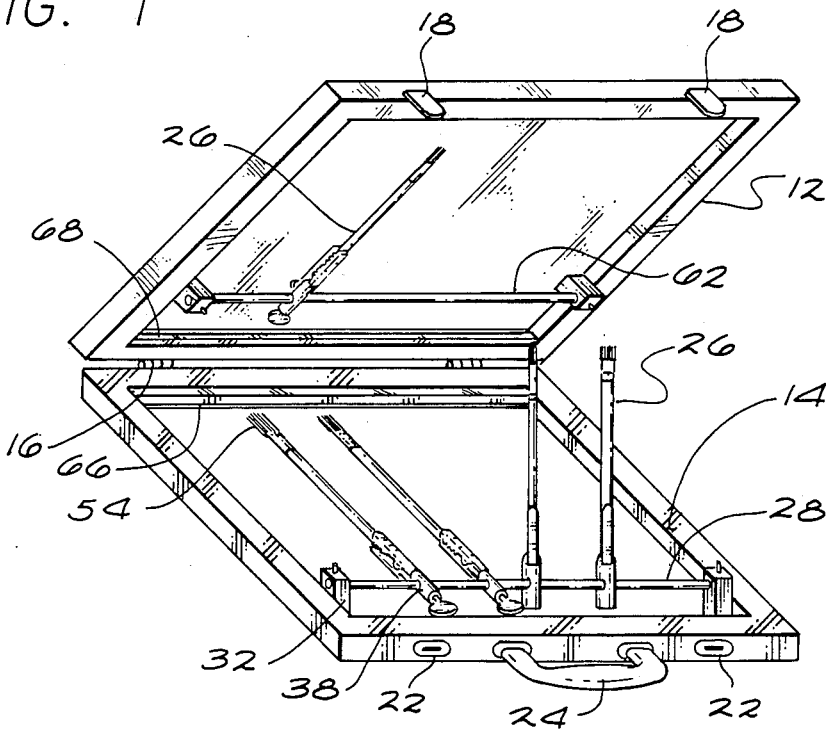
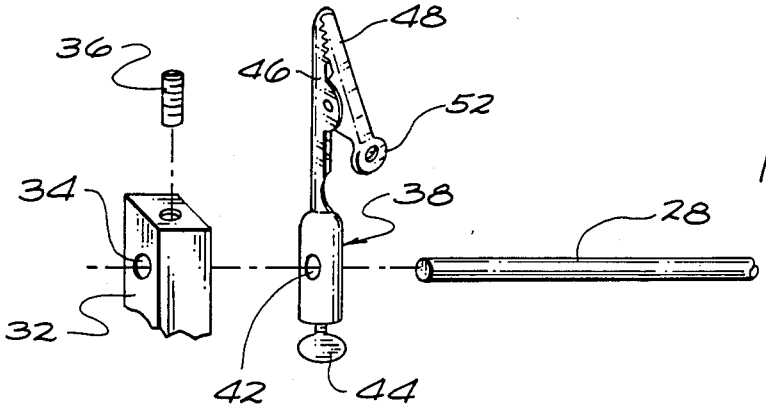
FIG. 2
FIG. 3
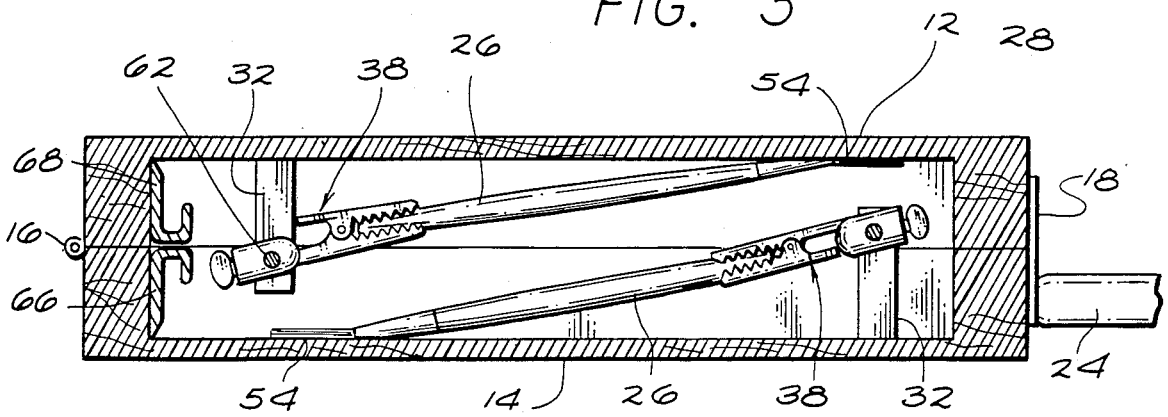

ARTIST BRUSH BOX

BACKGROUND OF THE INVENTION

1. Field of the Invention

The field of art towhich the invention pertains includes the field of artist's brush boxes, more particularly, with respect to a brush box having holders for positioning the brushes in a plurality of desired positions.

2. Description of the Prior Art

Conventional artist brush boxes merely hold the artist brushes in a random position. Certain boxes contain box separaters having apertures therein which enable the brushes to be aligned. However, none of the boxes contain individual brush holders which can position the brush bristles in a desired flat position, so as to preserve the integrity of the brush bristles for future use.

Known prior art includes U.S. Pat. Nos. 4,573,569; 4,162,005; 2,150,706; 4,134,525; 3,446,337; 3,077,977; 305,544 and British Pat. No. 207,293.

SUMMARY OF THE INVENTION

An artist brush box includes a plurality of brush holders each adapted to releasably secure an artist brush thereto. The brush holders are movable for adjustably positioning the brushes in the box. The holders are rotatably secured to a mounting rod, enabling the brushes to be rotatably positioned for placing the brush bristles flat against the surface of the brush box when not in use and rotated to a second position when the brushes are to be used by an artist.

The advantages of this invention, both as to its construction and mode of operation, will be readily appreciated as the same becomes better understood by reference to the following detailed description when considered in connection with the accompanying drawings in which like reference numerals designate like parts throughout the figures.

BRIEF DESCRIPTION OF THE DRAWINGS

FIG. 1 is a perspective view of an open artist brush box;

FIG. 2 is a partial exploded perspective view of the brush holder mechanis; and

FIG. 3 is a cross sectional view of the artist brush box when the box is closed.

DESCRIPTION OF THE PREFERRED EMBODIMENTS

Referring now to the drawings there shown in FIG. 1 an artist bruch box constructed in accordance with principles of the invention. The artist brush box is of conventional exterior design in that it includes an upper half 12 and a lower half 14 which when closed defines an enclosed box. The halves are joined at one end by a hinge 16 enabling the halves to open with respect to each other about the hinge. In addition, when closed, conventional locking latches 18 and 22 are provided and a handle 24 enables the box to be carried.

Each of the box halves 12 and 14 contain a mounting arrangement for securing artist brushes 26 therein. The mounting arrangement for each half is generally identical and contains a mounting rod 28 about which the brushes 26 can pivot. The mounting rod 28 is generally parallel to the axis of the hinge 16 and in the lower box half 14 is adjacent to the handle 24. Each of the mounting rod 28 ends is secured to an end mount 32.

As can be seen in FIG. 2, the end mount 32 contains an aperture into which the mounting rod 28 can be inserted and secured therein by means of a conventional set screw 36. Typically, the end mounts 32 are secured to the interior edges of the lower half 14 and permanently affixed thereto such as by adhesive or other conventional securing technique.

The plurality of artist brush holders 38 are positioned on the mounting rod 28. Each artist brush holder contains a central opening 42 through which the mounting rod 28 passes enabling the brush holders 38 to pivot and rotate about the mounting rod. A thumb screw 44 at the end of brush holders 38 extends into the central opening 42 and enables the brush holders to be affixed to the mounting rod 28 so as to either enable the brush holders to rotate or to remain in a fixed positioning depending on the tightness of the thumb screw 44 with respect to the mounting rod.

The brush holders 38 each contain an integrally formed securing mechanism formed of a first fixed jaw 46 extending from one end of the brush holder 38 and pivotably affixed spring-biased movable jaw 48. The movable jaw 48 contains a release end 52 which causes the jaws 46 and 48 to separate, enabling the free end of an artist brush 26 to be inserted therein as illustrated in FIG. 1.

The brushes illustrated in a horizontal position in FIG. 1 and FIG. 3 have their bristles 54 lying flat against the interior surface of the box lower half 14. This is the desired position to have the bristles when the brushes are not being used. When the brushes are being used, the thumb screw 44 is rotated so that the brush holders 38 can rotate about the mounting rod 28. The brushes mounted on the right of box lower half 14 in FIG. 1 illustrate the brushes in a generally vertical position for ease of access to the artist for use. However, as can be seen the brushes mounted in the box lower half 14 on the left have their bristles firmly positioned in a flat surface of the lower half 14 interior surface and remain in this position once the brush holders 38 are secured to the mounting rod 28 in a non-rotatable position by tightening the thumb screw 44.

The upper half 12 of the artist brush box is similar configured to lower box half 14. However, the corresponding mounting rod 62 is positioned adjacent the hinge 16 end of the box so that the brushes 26 secured by brush holders 38 associated with the mounting rod 62 will not conflict with the brushes in the brush box lower half 14 when the brush box is closed. (see FIG. 3).

Generally U-shaped channels 66 and 68 are formed at the hinge end of each of the box halves generally parallel to the axis of the hinge 16. These channels 66 and 68 retain any residue brush cleaning oil in the box when the box is being carried by the handle 24 so that oil does not seep through the seams of the box adjacent the hinge 16.

In addition, it should be noted that a securing tool could be provided within the box for tightening and loosening the thumb screws 44.

Further, it should be understood that the mounting rods 28 and 62 could be positioned on opposite ends of the lower half 14 and the upper half 12, respectively in planes perpendicular to the hinge 16 axis, rather than perpendicular to the hinge axis. In this manner, longer brushes could be carried in the box. However, the number of brushes carried would be reduced.

I claim:

1. An artist brush box comprising:

an upper half and a lower half which when closed defines an enclosed box for holding brushes, said halves being joined together at one end for opening the halves with respect to each other at a second end about a first axis, each box half having a generally planar interior surface;

at least one mounting rod secured to one of said box halves adjacent said box half second end; said mounting rod having brush securing means positionted thereon for securing a brush having a handle at one end and bristles at the other end to said securing means at said handle end, said securing means being rotatable about said mounting rod for positiong said brushes in a plurality of positions, including a first position wherein said brush bristles lie flat against one of said box half planar interior surfaces and a second position wherein said brush bristles are spaced from said box half planar interior surface.

2. An artist brush box in accordance with claim 1 wherein said brush securing means includes a thumb screw extending along an axis perpendicular to the axis of said mounting rod for locking said brush securing means in a fixed position.

3. An artist brush box in accordance with claim 1 wherein U-shaped channels are formed at the hinge end of said box halves having an axis generally parallel to the hinge axis for retaining residue liquid in said brush box.

* * * * *